US005823669A

United States Patent [19]

Jones

[11] Patent Number: 5,823,669

[45] Date of Patent: Oct. 20, 1998

[54] METHOD FOR BLENDING DIVERSE BLOWING AGENTS

[75] Inventor: Clifford Jones, Lawrenceville, Ga.

[73] Assignee: Lolco Packaging Corp., Studio City, Calif.

[21] Appl. No.: 421,128

[22] Filed: Apr. 12, 1995

Related U.S. Application Data

[60] Continuation-in-part of Ser. No. 188,344, Jan. 27, 1994, Pat. No. 5,423,607, which is a division of Ser. No. 963,235, Oct. 19, 1992, abandoned, which is a continuation of Ser. No. 695,352, May 3, 1991, abandoned.

[51] Int. Cl.[6] ..... B01F 15/04

[52] U.S. Cl. ..... 366/132; 366/136; 366/160.2; 366/162.1; 366/152.1; 264/DIG. 5; 264/53

[58] Field of Search ..... 366/144, 145, 366/148, 151.1, 152.1, 152.2, 160.2, 162.1, 182.1, 182.2, 132, 134, 348, 136; 264/53, 54, DIG. 5, 50; 521/74, 133; 425/207

[56] References Cited

U.S. PATENT DOCUMENTS

| | | | |
|---|---|---|---|
| 4,424,287 | 1/1984 | Johnson et al. | 264/53 |
| 4,427,298 | 1/1984 | Fahy et al. | 366/132 |
| 4,621,927 | 11/1986 | Hiroi | 366/132 |
| 4,778,631 | 10/1988 | Cobbs, Jr. et al. | 425/4 R |
| 5,049,328 | 9/1991 | Meyer et al. | 264/53 |
| 5,082,142 | 1/1992 | Saidman et al. | 222/1 |

*Primary Examiner*—David Scherbel
*Assistant Examiner*—Tony G. Soohoo
*Attorney, Agent, or Firm*—Robbins, Berliner & Carson, LLP

[57] ABSTRACT

An apparatus and method for continuously and accurately blending a plurality of diverse, normally gaseous or volatile liquid components, preferably two or three, at low pressures. In a preferred embodiment, and apparatus blends a first stream of volatile liquid component, preferably carbon dioxide with a liquid stream of any suitable hydrocarbon (including halogenated hydrocarbons) blowing agent in accordance with any predetermined ratio desired by those skilled in the art before introducing the blend into a suitable extrusion process for preparation of polymeric foams and the like. The apparatus combines the liquid components at a pressure substantially higher than the elevated pressure required during the extrusion process. In an alternative embodiment, the blending apparatus blends a liquid stream of volatile liquid component, preferably carbon dioxide with a liquid stream of a first hydrocarbon blowing agent in accordance with any predetermined ratio and subsequently blends a second hydrocarbon blowing agent with the blend of the liquid carbon dioxide and the first hydrocarbon blowing agent.

11 Claims, 5 Drawing Sheets

METHOD FOR BLENDING DIVERSE BLOWING AGENTS

This is a continuation-in-part of U.S. patent application Ser. No. 08/188,344, filed Jan. 27, 1994, now U.S. Pat. No. 5,423,608, which in turn was a division of U.S. patent application Ser. No. 07/963,235, filed Oct. 19, 1992, now abandoned, which in turn was a continuation of U.S. patent application Ser. No. 07/695,352, filed May 3, 1991, now abandoned.

FIELD OF THE INVENTION

The present invention relates generally to the field of blending diverse, normally gaseous or volatile liquid blowing agents, in applications such as the preparation of polymeric foams or the like. More specifically, the present invention relates to an apparatus for blending such diverse blowing agents at predetermined pressures, prior to introducing them through an extrusion process or the like, at elevated pressures, to form a thermoplastic extrusion mass.

BACKGROUND OF THE INVENTION

In the preparation of polymeric foams or the like, significant advances have been made with the introduction of systems for mixing molten resin with blowing agents—said various normally gaseous or volatile liquid components—under high pressure. Pressures of at least about 3500 p.s.i.g. (pounds per square inch gauge) are typically required to ensure that the molten resin and blowing agents are suitably mixed. Extrusion of the resulting molten mixture into a low pressure zone results in foaming of a thermoplastic extrusion mass, by vaporization of the blowing agents. After a typical extrusion foaming step, the extruded material is ordinarily aged and then is thermoformed into containers and the like.

A variety of normally gaseous or volatile liquid blowing agents are used with olefinic or styrenic polymers. Representative blowing agents are common atmospheric gases (e.g. nitrogen and carbon dioxide) and hydrocarbons, including halogenated hydrocarbons (e.g., the $C_4$–$C_6$ alkanes and chloro-fluoro methanes and ethanes).

Because carbon dioxide costs less than hydrocarbon blowing agents, it is economically advantageous to dilute hydrocarbon blowing agents with carbon dioxide. Use of carbon dioxide is also desirous, because during aging, blowing agents can escape into the atmosphere. The potential atmospheric pollution caused by the release of the blowing agents, in particular, by the release of certain halogenated hydrocarbons has led those in the industry to seek blowing agents comprised largely or entirely of non-polluting gases. Carbon dioxide is particularly beneficial because it is safe for food contact and is extensively used for direct contact freezing of food stuff.

Unfortunately, the extreme volatility of normally gaseous materials, such as carbon dioxide, has posed considerable problems in controlling the foaming process. Lack of proper control results in surface defects and corrugations in the extruded sheet material.

In an attempt to overcome these control problems, systems have been proposed for injecting a mixture of alkane liquid and carbon dioxide liquid into a molten extrusion mass, in a continuous extruder unit. U.S. Pat. No. 4,344,710 to Johnson et al. discloses one such system. The system proposed by Johnson et al. utilizes fluid handling means for pumping a plurality of diverse volatile liquids, including carbon dioxide, from a liquid source to the extruder means. A storage means maintains liquefied carbon dioxide under pressure. Heat exchange means connected to the storage means cools the liquefied carbon dioxide to prevent flashing thereof during pumping. A pump connected between the cooling means and the extruder means increases the pressure of the first stream to a level higher than the elevated pressure of the extruder, where it is combined with a pressurized stream of a second liquid blowing agent. The pump increases the pressure from a storage pressure ranging between 50–75 atmospheres (approximately 750–1125 p.s.i.g.), to an elevated injection pressure of about 340 atmospheres (approximately 5100 p.s.i.g.).

Such extremely high pressures are used in order to maintain the blowing agents in a liquid state and adequately control the mixing process. To maintain such high pressures, however, is expensive, difficult and hazardous. In addition, the system proposed by Johnson et al. is manually controlled, which substantially affects the accuracy of the ratios of the components of the extrusion mass.

A need thus exists for an improved apparatus which can blend a plurality of diverse, volatile liquid blowing agents at lower pressures which are less hazardous and can more efficiently and accurately control the ratio of the blowing agents.

SUMMARY OF THE INVENTION

The present invention provides a blending apparatus or system for continuously and accurately blending a plurality of diverse, volatile liquid components, preferably two or three, at least one of which is normally gaseous, at low pressures, preferably at 500 p.s.i.g. In a preferred embodiment, the diverse volatile liquid components are blended prior to introducing the blend into an extrusion process for preparation of polymeric foams or the like. The components are combined at pressures substantially lower than the elevated pressure of the extruder.

In an alternative embodiment of the invention, the present invention provides an apparatus for blending diverse blowing agents for delivery of the agents to an extruder for mixture therein with a thermoplastic molten resin to form a foamed thermoplastic extrusion mass. The apparatus comprises a supply of liquid carbon dioxide, a refrigerated storage tank containing and maintaining the supply of carbon dioxide in a liquid state at a temperature sufficient to prevent flashing thereof at a predetermined pressure of less than 500 p.s.i.g., a first forwarding pump means operatively connected to the storage tank for pumping the supply of carbon dioxide in the liquid state to a pressure of approximately 550 p.s.i.g. to prevent cavitation, a first high pressure pump means operatively connected to the first pump means for further pumping the supply of carbon dioxide to a pressure of approximately 5,500 p.s.i.g and providing a stream thereof, a supply of first liquid blowing agent for the molten thermoplastic, first means for storing the supply of first liquid blowing agent and providing a stream thereof, a second forwarding pump means operatively connected to the first storage means for pumping the supply of first liquid blowing agent to a pressure of approximately 550 p.s.i.g. to prevent cavitation, a second high pressure pump means operatively connected to the second forwarding pump means for further pumping the supply of first liquid blowing agent to a pressure of approximately 5,500 p.s.i.g and providing a stream thereof, means for measuring the flow rate of the stream of carbon dioxide and providing a first signal proportional thereto, means for measuring the flow rate of the stream of first blowing agent and providing a second signal proportional thereto, control means responsive to the first and second signals to control the flow rate of the stream of blowing agent whereby to provide a predetermined ratio of blowing agent and carbon dioxide, blending means for mixing the streams of carbon dioxide and blowing agent at a pressure of approximately 5,500 p.s.i.g. and providing a blend thereof, and means for introducing the blend into the extruder.

In another embodiment of the invention, the present invention provides a method for blending diverse blowing agents for delivery of the agents to an extruder which contains molten thermoplastic resin at a pressure of at least 3500 p.s.i.g. for mixture therein with the thermoplastic molten resin to form a foamed thermoplastic extrusion mass. The method comprises providing a refrigerated supply of liquid carbon dioxide, maintaining the supply of carbon dioxide in the liquid state at a pressure of less than 500 p.s.i.g. and at a temperature to prevent flashing thereof, pumping the supply of carbon dioxide in the liquid state to a pressure of approximately 550 p.s.i.g. to prevent cavitation, further pumping the supply of carbon dioxide to a pressure of approximately 5,500 p.s.i.g. and providing a stream thereof, providing a supply of first liquid blowing agent, pumping the supply of first liquid blowing agent to a pressure of approximately 550 p.s.i.g to prevent cavitation, further pumping the supply of first volatile liquid blowing agent to a pressure of approximately 5,500 p.s.i.g. and providing a stream thereof, measuring the flow rate of the stream of carbon dioxide and providing a first signal proportional thereto, measuring the flow rate of the stream of first blowing agent and providing a second signal proportional thereto, controlling the flow rate of the stream of first blowing agent responsive to the first and second signals whereby to provide a ratio of blowing agent and carbon dioxide, mixing the streams of carbon dioxide and first blowing agent at a pressure of approximately 5,500 p.s.i.g. to form a blend thereof and pumping the blend into the extruder whereby to form a foamed thermoplastic mass.

These as well as other features of the invention will become apparent from the detailed description which follows, considered together with the appended drawings.

BRIEF DESCRIPTION OF THE DRAWINGS

A preferred embodiment and alternative embodiments of the present invention are illustrated in and by the following drawings in which like reference numerals indicate like parts and in which.

DETAILED DESCRIPTION OF THE PREFERRED EMBODIMENTS

Figure 1:
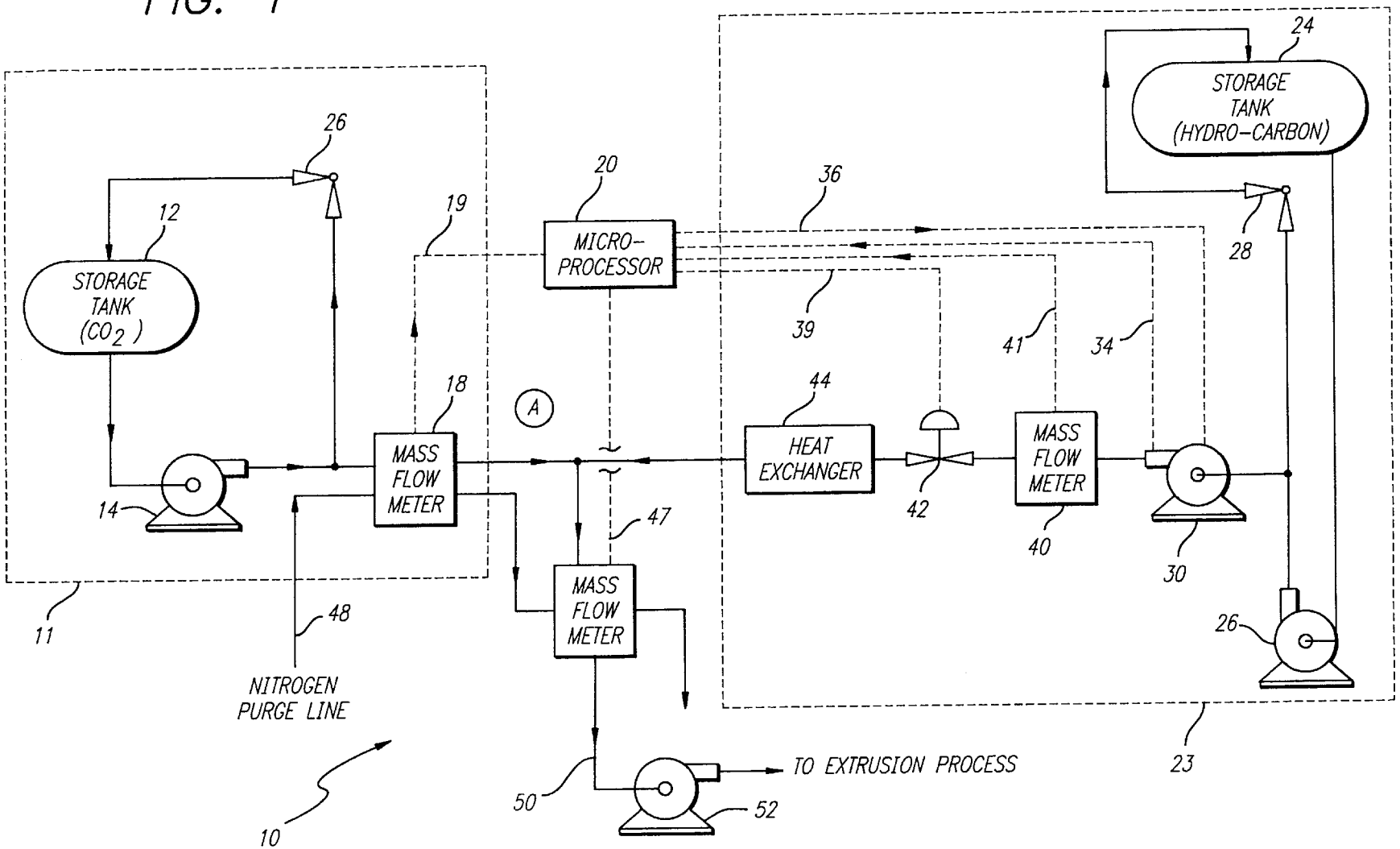
FIG. 1 is a schematic diagram of an apparatus in accordance with the present invention for blending two volatile liquid blowing agents.
Figure 2:
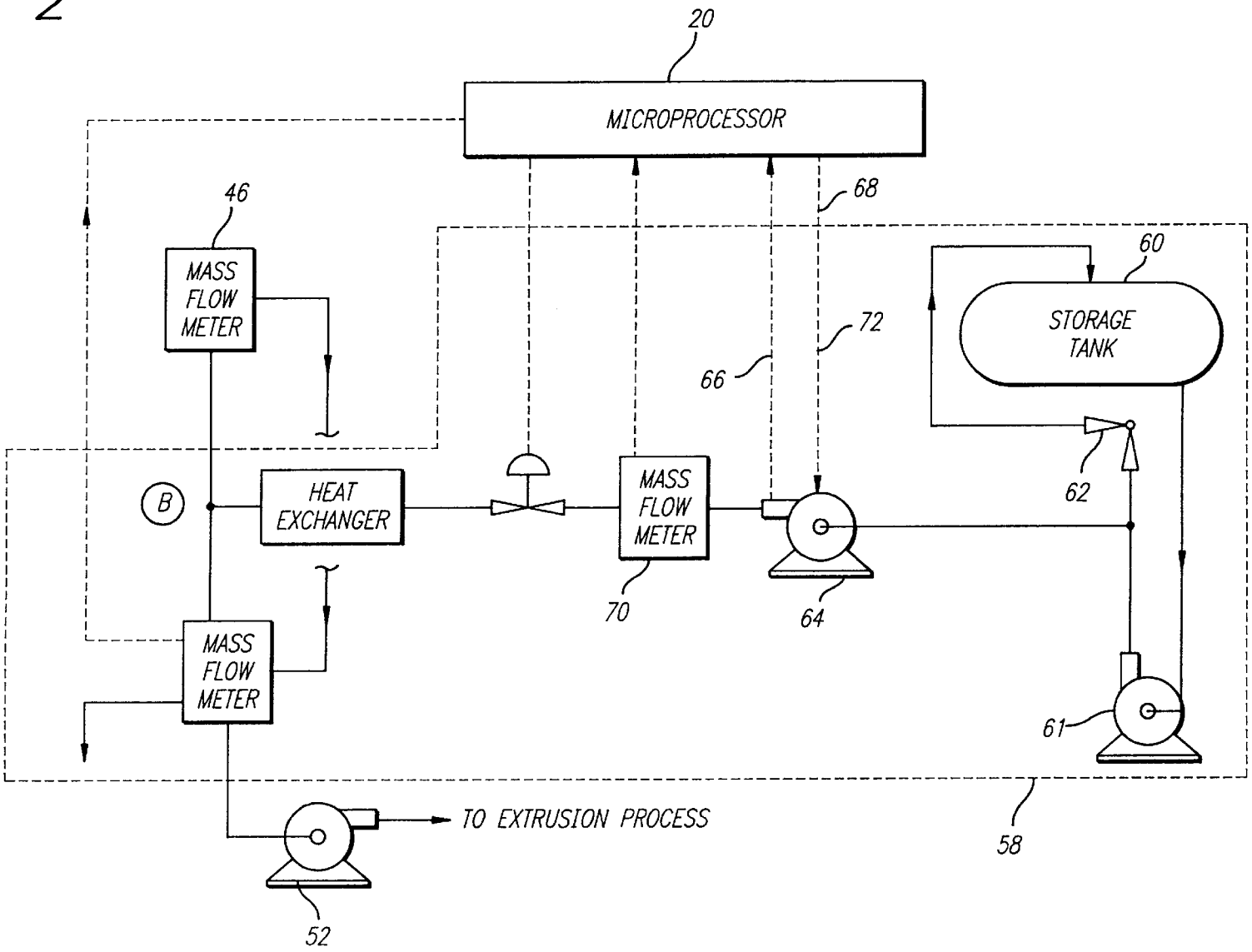
FIG. 2 is a schematic diagram of an apparatus in accordance with the present invention for blending three volatile liquid blowing agents.

The blending apparatus 10 of the present invention continuously and accurately blends a plurality of diverse, volatile liquid components, at least one of which is normally gaseous. FIG. 1 shows generally a schematic diagram of the blending apparatus 10 in accordance with one preferred embodiment of the present invention. In this embodiment, the blending apparatus 10 is configured to continuously and accurately blend a binary stream of liquid carbon dioxide and any hydrocarbon blowing agent, including any halogenated hydrocarbon blowing agent, prior to introducing the blend into an extrusion process or the like. The embodiments illustrated herein merely exemplify the invention which may take forms different from the specific embodiments disclosed or may be used in applications different from the specific application disclosed.

The blending apparatus 10 comprises a first supply source 11 for providing a first stream of a normally gaseous blowing agent. The first supply source 11 comprises a first storage tank 12 configured to maintain the normally gaseous blowing agent in its liquid state. In a preferred embodiment, the first blowing agent is liquefied carbon dioxide maintained at low pressure, preferably in the range of 250–300 p.s.i.g. (pounds per square inch gauge), at a temperature of preferably −8° Fahrenheit. Maintaining the liquid carbon dioxide at a low pressure within the range 250–300 p.s.i.g. and a temperature of −8° F. advantageously prevents flashing thereof. The first storage tank 12 is preferably any refrigerated tank having a capacity of about 30 tons, such as one commercially available from Liquid Carbonics, located in Chicago Ill. Alternatively, the first storage tank 12 may be of any suitable construction and capacity as desired by those skilled in the art.

The first supply source 11 also includes a first multi-stage turbine pump 14 operatively disposed in fluid communication with the first storage tank 12, preferably via conventional piping. In an exemplary embodiment, the first storage tank 12 is positioned about 4 feet above the first turbine pump 14 and the piping is preferably constructed from stainless steel to prevent it from being affected by low temperatures. The first turbine pump 14 may be one such as that manufactured by SIHI and commercially available from Shermans & Schroeder Equipment Company, located in Cincinnati, Ohio.

A motor (not shown) drives the first turbine pump 14 and is adapted to operate at a speed of about 1750 rpm (revolutions per minute). The first turbine pump 14 boosts the discharge pressure of the first blowing agent, liquid carbon dioxide, to a level preferably about 100–150 p.s.i.g. above the pressure at which it is maintained in the first storage tank 12, preferably in the range of 350–500 p.s.i.g. The temperature of the liquid carbon dioxide remains substantially the same, except for a slight variation which is caused by the heat generated in the first turbine pump 14.

The first turbine pump 14 can have a capacity to pump liquid at a flow rate which is in excess of a flow rate desired by those skilled in the art. A first pressure relief valve 16 operatively connected between the first turbine pump 14 and the first storage tank 12 returns any excess flow of fluid to the first storage tank 12. The head pressure in the first turbine pump 14 is determined by setting the first pressure relief valve 16 at a pressure level above the pressure in the first storage tank 12. The first pressure relief valve 16 is preferably set at 100–150 p.s.i.g. above the pressure in the first storage tank 12. The first pressure relief valve 16 is of conventional design and is preferably constructed from stainless steel. In one exemplary embodiment, the liquid carbon dioxide is drawn from the first storage tank 12 at a flow rate of 2 GPM (gallons per minute) and at a pressure of 394 p.s.i.g.

The first supply source 11 comprises a first flow measurement means, such as a first mass flow meter 18 which is operatively connected in fluid communication to the first turbine pump 14 to monitor the flow of liquid carbon dioxide therethrough. The first mass flow meter 18 may be one such as that manufactured by Micro-Motion, Boulder, Colo. The first mass flow meter 18 generates an electrical signal transmitted over a line 19, which indicates the flow rate of liquid carbon dioxide through the first mass flow meter 18. The electrical signal over the line 19 is in the range of 4–20 ma (milliamperes) and is transmitted to a microprocessor 20, which may be of any conventional type, such as one commercially available from Leeds & Northrup Micromax.

A coupling or blending means, indicated at A, joins the flow of liquid carbon dioxide with a stream if a second blowing agent supplied by a second supply source 23. The blending means A is disposed in fluid communication between the first supply source 11 and the second supply source 23. In a preferred embodiment, the blending means, indicated at A is any suitable tee, of conventional design.

In a preferred embodiment, the second supply source 23 supplies any suitable hydrocarbon blowing agent, such as n-pentane. However, similar results may be obtained by using any blowing agent. Representative blowing agents include hydrocarbons, such as propane, n-butane, i-butane, n-pentane and i-pentane and halogenated hydrocarbons such as chloromethane, methylene chloride 1,1,1-trichloro-1-fluoromethane (CFC-11), 1,1-dichloro-1,1-diflouromethane (CFC-12), 1-chloro-1,1-difluoro-methane (CFC-22), 1,1,2-trichloro-1,2,2-trifluroethane (CFC-113), 1,2-dichloro- 1,1, 2,2-tetrafluoroethane (CFC-114), 1-Chloro-1,1,2,2,2-pentafluoroethane (CFC-115), 1-chloro-1,1-difluoroethane (CFC-142b), 1,1 difluoroethane (CFC-152a), 1,1,dichloro-2,2-2 trifluoroethane (CFC-123), 1,2-dichloro-1,2,2-triflouroethane (CFC-123c), 1-chloro-1,2,2,2-tetrafluoroethane (CFC-124), and 1,2,2,2-tetrafluoroethane (CFC-104a).

The stream of the hydrocarbon blowing agent is regulated in a manner described in greater detail below, to provide any predetermined ratio of the hydrocarbon blowing agent to the liquefied carbon dioxide, as desired by those skilled in the art. In one exemplary embodiment, the stream of the hydrocarbon blowing agent was regulated to provide a 70% to 30% ratio, 70% of the hydrocarbon blowing agent to 30% of the liquid carbon dioxide. The second supply means 23 can be regulated to deliver anywhere from 0–100% of the hydrocarbon blowing agent.

The hydrocarbon blowing agent is stored in a second storage tank 24, of any suitable construction and capacity desired by those skilled in the art. For example, a gasoline tank suitable for storing normal pentane or normal butane at ambient temperature may be used. Normal butane is pressurized by an amount sufficient to maintain it in liquid form. The second storage tank 24 is operatively connected in fluid communication to a second turbine pump 26, via conventional piping. The second turbine pump 26 is of a type similar to the first turbine pump 14, and draws the hydrocarbon blowing agent from the storage tank 24 at a pressure 50 p.s.i.g. above the pressure level in the second storage tank 24.

Flow in excess of any amount desired by those skilled in the art is returned to the second storage tank 24 through a second pressure relief valve 28 operatively connected in fluid communication between the second turbine pump 26 and the second storage tank 24. The second pressure relief valve 28, of commercially available design, is similar to the first pressure relief valve 16.

In order to develop a net positive suction head sufficient to ensure that a positive displacement pump 30 operatively connected to the second pressure relief valve 28 and second turbine pump 26 is properly primed the second pressure relief valve 28 is preferably set at a pressure level of 50 p.s.i.g. greater than the pressure in the second storage tank 24. The displacement pump 30 raises the fluid pressure to approximately 550 p.s.i.g. The displacement pump 30 is any positive diaphragm pump, conventionally known in the art.

The stroke length of the displacement pump 30 is manually controlled to create any flow rate desired by those skilled in the art and the stroke frequency is varied to keep the pressure constant. The displacement pump 30 contains a pressure transmitter (not shown), of conventional design, at its discharge end. The pressure transmitter generates an electrical signal representative of the fluid pressure and transmits it to the microprocessor 20, over a line 34. The microprocessor 20 transmits a signal, over a line 36, to a variable frequency drive (not shown) of the displacement pump 30, thereby controlling the pressure created by the displacement pump 30.

The hydrocarbon blowing agent passes through a second flow measurement means, which is a second mass flow meter 40. The second mass flow meter 40 is any mass flow meter known to those skilled in the art, such as one available from Micro-Motion, located in Boulder, Colo. The second mass flow meter 40 monitors the amount of flow and transmits a signal representative of the flow rate to the microprocessor 20 over a line 41.

The microprocessor 20 compares the flow rate of hydrocarbon blowing agent measured by the second mass flow meter 40, to the flow rate of liquid carbon dioxide, measured by the first mass flow meter 18. Depending upon the comparison, a signal is transmitted over a line 39 to a flow control valve 42, of conventional design. The flow control valve 42 adjusts the flow rate of the hydrocarbon blowing agent to maintain any ratio desired by those skilled in the art. The controlled stream of hydrocarbon blowing agent passes to a heat exchanger 44 where it is sufficiently cooled, so that it can be safely blended with the liquified carbon dioxide stream without the danger of flashing, typically to about 20° Fahrenheit. The heat exchanger 44 may be of any suitable type, such as a Graham Heli-Flow Heat Exchanger Model 8S4C-10B.

The stream of hydrocarbon is combined with the stream of liquid carbon dioxide at mixing point A. After blending, the temperature of the combined streams is about 0° Fahrenheit. The binary stream of liquid carbon dioxide and hydrocarbon blowing agent then flows through a third flow measurement means such as a third mass flow meter 46. The mass flow meter 46, which is also manufactured by Micro-Motion, indicates the mass flow rate in pounds per hour. It also provides a temperature and specific gravity measurement. Calculations can be conducted based on these measurements to determine the actual composition or ratio of the binary blend. The third mass flow meter 46 provides signals indicating this information to the microprocessor 20 on a line 47. The third mass flow meter 46 serves as a check to ensure that the ratio of the binary blend is accurate.

The mass flow meters 18, 40 and 46 are continuously purged with nitrogen to prevent moisture from freezing on their moving parts. The nitrogen is provided to the mass flow meters 18, 40 and 46 through a purge line 48.

The binary stream flows through the third mass flow meter 46, and passes to a suction side 50 of a second positive displacement pump 52. The second positive displacement pump 52 is of a type similar to the displacement pump 30. In one exemplary embodiment, the flow rate of the binary stream from the second displacement pump 52 was about 2.663 GPH gallons per hour. This reading did not take into consideration the very slight change in density from combining the carbon dioxide at −8° Fahrenheit and the hydrocarbon blowing agent at 20° Fahrenheit. The second displacement pump 52 forwards the binary stream of blowing agents to the extruders (not shown), where the blowing agents are used to expand the polystyrene foam sheet.

The invention may be extended for application in a tertiary system wherein three diverse, volatile components are continuously and accurately blended at relatively low pressures. In an alternative embodiment, the blending apparatus continuously and accurately blends a binary stream of a hydrocarbon blowing agent, such as n-pentane and a liquefied carbon dioxide blowing agent with a third blowing agent, preferably a second hydrocarbon blowing agent, such as HCFC-22. A third supply source 58 is operatively connected between the third mass flow meter 46 and the second positive displacement pump 52.

The third supply source 58 contains a third storage tank 60 for storing the second hydrocarbon blowing agent. The third storage tank 60 is of any suitable construction and capacity as desired by those skilled in the art. The third storage tank 60 is operatively connected in fluid communication to a third turbine pump 61, via conventional piping. The third turbine pump 61 is of a type similar to the first and second turbine pumps 14 and 26. The third turbine pump 61 draws the second hydrocarbon blowing agent from the storage tank 61 at a pressure level 50 p.s.i.g. above the pressure level in the third storage tank 61.

Flow in excess of any amount desired by those skilled in the art is returned to the third storage tank 60 through a third pressure relief valve 62, operatively connected in fluid communication between the third turbine pump 61 and the third storage tank 60. The third pressure relief valve 62, of commercially available design, is similar to the first and second pressure relief valves 16 and 28. In order to develop a net positive suction head sufficient to ensure that a third positive displacement pump 64 operatively connected to the third pressure relief valve 62 and the third turbine pump 61 is properly primed, the third pressure relief valve 62 is set at 50 p.s.i.g. above the pressure level in the third storage tank 60. The third displacement pump 64, which is preferably a positive diaphragm pump, raises the fluid pressure to approximately 550 p.s.i.g.

The stroke length of the third displacement pump 64 is manually controlled to create any flow rate desired by those skilled in the art and the stroke frequency is varied to maintain the pressure constant. The third displacement pump 64 contains a pressure transmitter (not shown), of conventional design, at its discharge end. The pressure transmitter generates an electrical signal representative of the fluid pressure and transmits it to the microprocessor 20 over a line 66. The microprocessor 20 transmits a signal over a line 68 to a variable frequency drive (not shown) of the third displacement pump 64, thereby controlling the pressure created by the third displacement pump 64.

The stream of hydrocarbon fluid passes through a fourth flow measurement means such as a fourth flow measurement meter 70. The fourth flow measurement meter 70 is any suitable mass flow meter, such as one available from Micro-Motion, Boulder, Colo. The fourth mass flow meter 70 monitors the amount of flow and transmits a signal representative of the flow rate to the microprocessor 20, over a line 72.

The microprocessor 20 compares the ratio of the rate of flow of the second hydrocarbon blowing agent, measured by the fourth mass flow meter 70, to the rate of flow of the binary blend of the liquefied carbon dioxide blowing agent and hydrocarbon blowing agent, measured by the third mass flow meter 46. Depending upon the comparison, a signal is transmitted over a line 74 to a flow control valve 76, of conventional design. The flow control valve 76 adjusts the flow rate of the second hydrocarbon blowing agent to maintain any predetermined ratio desired by those skilled in the art. The controlled stream of the second hydrocarbon blowing agent passes to a heat exchange 78 where it is sufficiently cooled to approximately 20° Fahrenheit, so that it can be safely blended with the binary blend without the danger of flashing. The heat exchanger 78 may be of any suitable type, such as a Graham Heli-Flow Heat Exchanger Model 8S4C-10B.

The second hydrocarbon blowing agent is combined with the binary blend of the first and second streams at a mixing point, indicated at B. At mixing point B, blending of the two streams at different temperatures (the binary blend at 0 degrees Fahrenheit and the cooled second hydrocarbon blowing agent at approximately 20 degrees Fahrenheit) causes the temperature of the tertiary blend to rise above 0 degrees Fahrenheit. The tertiary stream of the combined liquid carbon dioxide blowing agent and hydrocarbon blowing agents then flows through a fifth flow measurement means such as a fifth flow measurement meter 80. The fifth mass flow meter 80, which is also manufactured by Micro-Motion, indicates the mass flow rate in pounds per hour. It also provides a temperature and specific gravity measurement. Based on these measurements, calculations can be conducted to determine actual composition or ratio of the tertiary blend. The fifth mass flow meter 80 provides signals indicating this information to the microprocessor 20 on a line 84. The fifth mass flow meter 80 serves as a check to ensure that the ratio of each component in the tertiary blend is accurate.

The fifth mass flow meter 80 is also continuously purged with nitrogen to prevent moisture from freezing on its moving parts. The nitrogen is provided to mass flow meter 80 through a purge line 86.

Flow of the tertiary stream from the fifth mass flow meter 80 passes to the suction side 50 of the second positive displacement pump 52. The second positive displacement pump 52 forwards the tertiary stream of the extruders (not shown), where the blowing agents are used to expand the polystyrene foam sheet.

Figure 3:
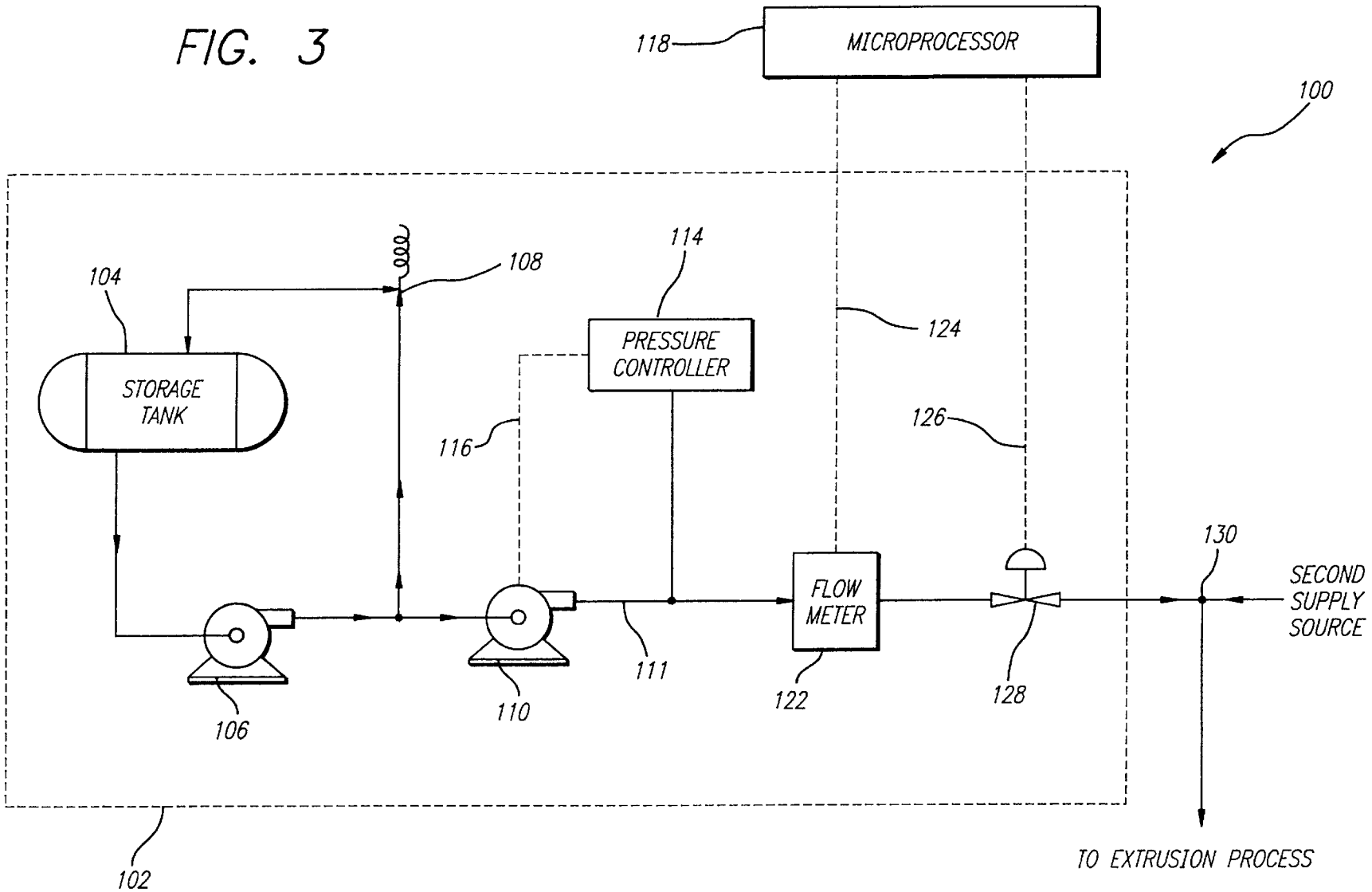
FIG. 3 is a schematic diagram of an apparatus in accordance with another embodiment of the invention which may be adapted to blend a plurality of volatile liquid blowing agents.
Figure 4:
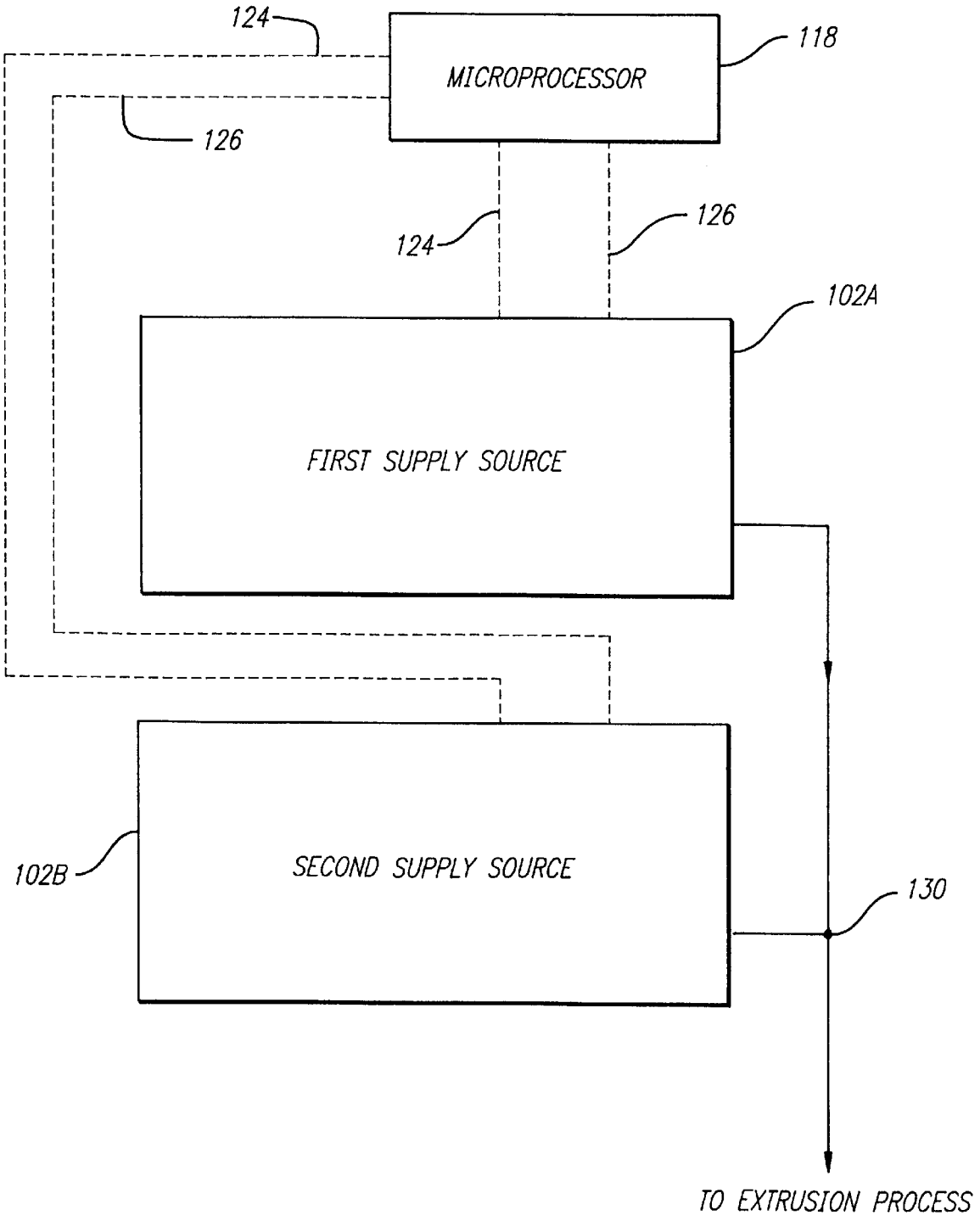
FIG. 4 is a schematic diagram of the apparatus shown in FIG. 3 adapted to blend two volatile liquid blowing agents.

FIG. 3 shows generally a schematic diagram of a blending apparatus 100 in accordance with another embodiment of the present invention which may be adapted to continuously and accurately blend a plurality of blowing agents. As shown in FIG. 4, the blending apparatus 100 shown in FIG. 3 may be adapted to continuously and accurately blend a binary stream of blowing agents, such as liquid carbon dioxide and any hydrocarbon blowing agent (including any halogenated hydrocarbon blowing agent) prior to introducing the blend into an extrusion process or the like. The present invention, however, is not limited to the binary system shown in FIG. 4, but rather may be adapted to blend as many blowing agents as desired.

As shown in FIG. 3, the blending apparatus 100 includes a forwarding pump 106 for preventing cavitation in the line to the first high pressure pump 110 and a stroke controlled high pressure pump 110 for boosting the pressure of the blowing agent. In accordance with the present invention, by combining the action of the first forwarding pump 106 and the high pressure pump 110 with a pneumatic controller 114, virtually any number of streams of different blowing agents with varying ratio and total flow rate as desired may be blended. The embodiments illustrated herein merely exemplify the invention which may take forms different from the specific embodiments disclosed or may be used in applications different from the specific application disclosed.

The blending apparatus 100 comprises a first supply source 102 for providing a first stream of a normally gaseous blowing agent. For illustrative purposes, the blending apparatus 100 shown in FIG. 3 will be described using liquified carbon dioxide as the blowing agent. The first supply source 102 comprises a first storage tank 104 configured to maintain the normally gaseous blowing agent in its liquid state. A blowing agent such as liquefied carbon dioxide is typically maintained at low pressure, preferably in the range of 250–300 p.s.i.g. (pounds per square inch gauge) and at a temperature of preferably −8° Fahrenheit to minimize flashing. The first storage tank 104 is preferably any refrigerated tank having a capacity of about 30 tons, such as one commercially available from Liquid Carbonics, located in Chicago Ill. Alternatively, the first storage tank 104 may be of any suitable construction and capacity as desired by those skilled in the art.

The first supply source 102 also includes a first forwarding pump 106 for boosting the blowing agent pressure that is in the first storage tank 104 to a pressure sufficient to prevent cavitation in the line to the high pressure pump 110. The first forwarding pump 106 is operatively disposed in fluid communication with the first storage tank 104, preferably via conventional piping. In an exemplary embodiment, the first storage tank 104 is positioned about 4 feet above the first forwarding pump 106 and the piping is preferably constructed from stainless steel to prevent it from being affected by low temperatures. The first forwarding pump 106 may be a turbine or vane type, such as that manufactured by SIHI and commercially available from Shermans & Schroeder Equipment Company, located in Cincinnati, Ohio.

A motor (not shown) drives the first forwarding pump 106 and is adapted to operate at a speed of about 1750 rpm (revolutions per minute). The first forwarding pump 106 boosts the discharge pressure of the blowing agent, liquid carbon dioxide, to a level preferably about 550 p.s.i.g. (the pressure maintained in the first storage tank 104 is preferably in the range of 350–500 p.s.i.g.). The temperature of the liquid carbon dioxide remains substantially the same, except for a slight variation which is caused by the heat generated in the first forwarding pump 106.

The first forwarding pump 106 can have a capacity to pump liquid at a flow rate which is in excess of a flow rate desired by those skilled in the art. A first pressure relief valve 108 operatively connected between the first forwarding pump 106 and the first storage tank 104 returns any excess flow of fluid to the first storage tank 104. The head pressure in the first forwarding pump 106 is determined by setting the first pressure relief valve 108 at a pressure level above the pressure in the first storage tank 104. In order to develop a net positive suction head sufficient to ensure that a first high pressure pump 110 operatively connected to the first pressure relief valve 108 and first forwarding pump 106 is properly primed, the first pressure relief valve 108 is preferably set at a pressure level of approximately 50 p.s.i.g. greater than the pressure in the first storage tank 104. The first pressure relief valve 108 is of conventional spring loaded design and is preferably constructed from stainless steel. In one exemplary embodiment, the liquid carbon dioxide is drawn from the first storage tank 104 at a flow rate of 2 GPM (gallons per minute) and at a pressure of 394 p.s.i.g.

The first high pressure pump 110 raises the fluid pressure to approximately 5,500 p.s.i.g. The first high pressure pump 110 is any positive diaphragm pump with pneumatic cylinders or electric positioners, one commercially available from America Lewa Inc., located in Holliston, Mass. The pressure in the high pressure pump may be varied. In particular, the first high pressure pump 110 is stroke controlled so that only enough blowing is pumped to maintain a set pressure, usually not to exceed 5,500 p.s.i.g. The stroke length of the first high pressure pump 110 is automatically controlled by the action of the pressure controller 114, preferably a pneumatic controller, to create any flow rate desired by those skilled in the art and the stroke frequency is held constant. The pressure output 111 of the first high pressure pump 110 is applied to the pressure controller 114 via a pipe connection. The output 116 of the pressure controller 114 is applied to the pump cylinders (not shown) of the first high pressure pump 110 and is a pneumatic signal, normally varied from 3 p.s.i.g. to 15 p.s.i.g., which resets the stroke length. At 3 p.s.i.g., the stroke length should be about 0% and at 15 p.s.i.g., the stroke length should be about 100%. The pressure controller 114 may be of any conventional type, such as one commercially available from Foxboro located in Foxboro, Mass.

A motor (now shown) drives the first high pressure pump 110 and is adapted to operate at a speed of about 1750 rpm. The motor is attached to a gear box (not shown) to give a stroke of about 180 per minute.

A first flow measurement means, such as a first mass flow meter 122, is operatively connected in fluid communication to the output 111 of the first high pressure pump 110 to monitor the flow of liquid carbon dioxide therethrough. The first mass flow meter 122 is any mass flow meter known to those skilled in the art, such as a Coriolis type mass flow meter available from Micro-Motion, located in Boulder, Colo. The first mass flow meter 122 generates an electrical signal transmitted over a line 124, which indicates the flow rate of liquid carbon dioxide through the first mass flow meter 122. The electrical signal over the line 124 is in the range of 4–20 ma (milliamperes) and is transmitted to a microprocessor 118.

The microprocessor 118 compares the flow rate of the liquid carbon dioxide blowing agent measured by the first mass flow meter 122, to the flow rate of one or more blowing agents supplied by other supply sources, measured by one or more mass flow meters, discussed in detail below. Depending upon the comparison, a signal is transmitted over a line 126 to a flow control valve 128, of conventional design. The flow control valve 128 adjusts the flow rate of the liquid carbon dioxide blowing agent to maintain any ratio desired by those skilled in the art. The microprocessor 118 may be of any conventional type, such as one commercially available from Fischer Porter in Warminster, Pa.

In particular, the microprocessor 118 compares the ratio of the rate of flow of the first hydrocarbon blowing agent measured by the mass flow meter 122 in the second supply source 102B, to the flow rate of liquid carbon dioxide measured by the mass flow meter 122 in the first supply source 102A. Depending upon the comparison, a signal is transmitted over a line 126 to the flow control valve 128 of the second supply source 102B. The flow control valve 128 in the second supply source 102B adjusts the flow rate of the first hydrocarbon blowing agent to maintain any predetermined ratio desired by those skilled in the art.

The stream of liquid carbon dioxide from supply source 102A is combined with the stream of hydrocarbon from supply source 102B at the multi-stream mixing means 130. The multi-stream mixing means 130 is disposed in fluid communication between the first supply source 102A and other supply sources, such as the second supply source 102B, shown in FIG. 4. In a preferred embodiment, the multi-stream mixing means 130 is any suitable tee, of conventional design.

The invention is not limited to the configuration shown in FIG. 3 but rather may be adapted to continuously and accurately blend a plurality of blowing agents, including but not limited to Freon® 12, Freon® 22, Freon® 134A, Freon® 142B, Freon® 152A, Carbon Dioxide, Pentanes, Butanes, Nitrogen, Argon, Ethanol and Air. In particular, the blending apparatus 100 shown in FIG. 3 may be adapted to blend as many blowing agents as desired. For example, as shown in FIG. 4, the first and second supply source 102A and 102B are configured to continuously and accurately blend a binary stream of blowing agents prior to introducing the blend into an extrusion process or the like. Supply sources 102A and 102B are constructed in accordance with supply source 102 shown in FIG. 3. For illustrative purposes, it will be assumed that liquid carbon dioxide and any hydrocarbon blowing agent, including any halogenated hydrocarbon blowing agent, are being blended. Referring to FIG. 4, the second supply source 102B supplies any suitable hydrocarbon blowing agent, such as n-pentane. However, similar results may be obtained by using any blowing agent. Representative blowing agents include hydrocarbons, such as propane, n-butane, i-butane, n-pentane and i-pentane and halogenated hydrocarbons such as chloromethane, methylene chloride 1,1,1-trichloro-1-fluoromethane (CFC-11), 1,1-dichloro-1,1-diflouromethane (CFC-12), 1-chloro-1,1-difluoro-methane (CFC-22), 1,1,2-trichloro-1,2,2-trifluroethane (CFC-113), 1,2-dichloro- 1,1,2,2-tetrafluoroethane (CFC-114), 1-Chloro-1,1,2,2,2-pentafluoroethane (CFC-115), 1-chloro-1,1-difluoroethane (CFC-142b), 1,1 difluoroethane (CFC-152a), 1,1,dichloro-2,2-2 trifluoroethane (CFC-123), 1,2-dichloro-1,2,2-triflouroethane (CFC-123c), 1-chloro-1,2,2,2-tetrafluoroethane (CFC-124), and 1,2,2,2-tetrafluoroethane (CFC-104a).

The stream of the hydrocarbon blowing agent is regulated in a manner described in greater detail below, to provide any predetermined ratio of the hydrocarbon blowing agent to the liquefied carbon dioxide, as desired by those skilled in the art. In one exemplary embodiment, the stream of the hydrocarbon blowing agent was regulated to provide a 70% to 30% ratio, 70% of the hydrocarbon blowing agent to 30% of the liquid carbon dioxide. The second supply means 102B can be regulated to deliver anywhere from 0–100% of the hydrocarbon blowing agent. The stream of hydrocarbon is combined with the stream of liquid carbon dioxide at the multi-stream mixing means 130 and then delivered to an extruder (not shown). After blending, the temperature of the combined streams is about 0° Fahrenheit.

Figure 5:
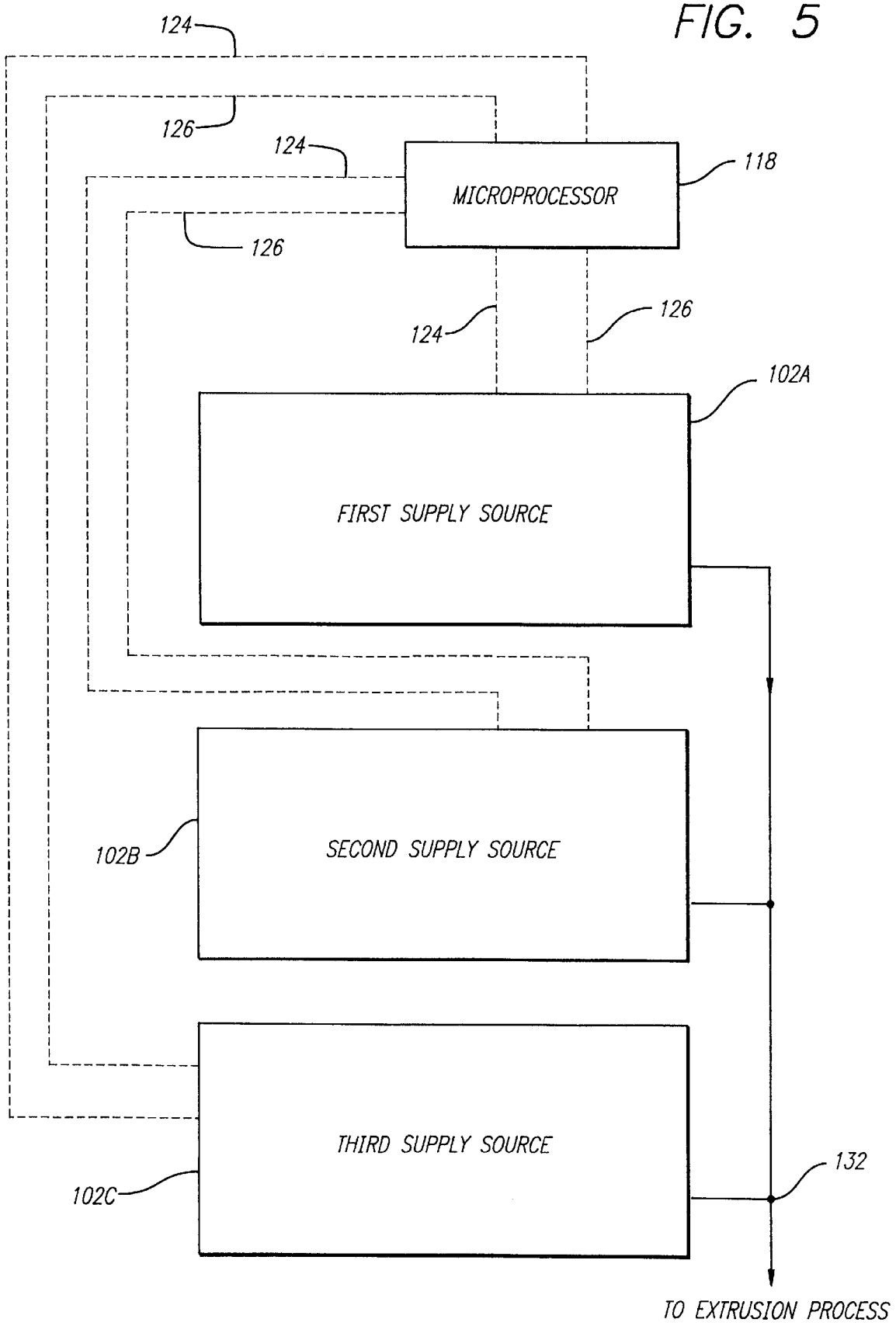
FIG. 5 is a schematic diagram of the apparatus shown in FIG. 3 adapted to blend three volatile liquid blowing agents.

The invention may be extended for application in a tertiary system wherein three diverse, volatile components are continuously and accurately blended, as shown in FIG. 5. The blending apparatus shown in FIG. 5 continuously and accurately blends a binary stream of a hydrocarbon blowing agent, such as n-pentane and a liquefied carbon dioxide blowing agent with a third blowing agent, preferably a second hydrocarbon blowing agent, such as HCFC-22. The third supply source 102C is constructed in accordance with supply source 102 shown in FIG. 3 and discussed in detail above, and contains the second hydrocarbon blowing agent.

The microprocessor 118 compares the ratio of the rate of flow of the second hydrocarbon blowing agent measured by the mass flow meter 122 in the third supply source 102C, to the rate of flow of the binary blend of the liquefied carbon dioxide blowing agent and first hydrocarbon blowing agent. Depending upon the comparison, a signal is transmitted over a line 126 to the flow control valve 128 of the third supply source 102C. The flow control valve 128 in the third supply source 102C adjusts the flow rate of the second hydrocarbon blowing agent to maintain any predetermined ratio desired by those skilled in the art. The second hydrocarbon blowing agent is combined with the binary blend of the first and second streams by a multi-stream mixing means 132 and then delivered to an extruder (not shown). The multi-stream mixing means 132 is disposed in fluid communication between the first, second and third supply sources 102A, 102B and 102C, respectively. The multi-stream mixing means 132 may be a conventional mixer, such as a commercial tee.

Although the invention has been described in terms of preferred embodiments thereof, other embodiments that are apparent to those of ordinary skill in the art are also within the scope of the invention. Accordingly, the scope of the invention is intended to be defined only by reference to the appended claims.

What is claimed is:

1. A method for blending diverse blowing agents for delivery of the agents to an extruder which contains molten thermoplastic resin at a pressure of at least 3500 p.s.i.g. for mixture therein with said thermoplastic molten resin to form a foamed thermoplastic extrusion mass, said method comprising:

providing a refrigerated supply of liquid carbon dioxide, maintaining said supply of carbon dioxide in said liquid state at a pressure of less than 500 p.s.i.g. and at a temperature to prevent flashing thereof, using a first pump to pump said supply of carbon dioxide in said liquid state to a pressure of approximately 550 p.s.i.g. to prevent line cavitation, further pumping said supply of carbon dioxide to a pressure of approximately 5,500 p.s.i.g. and providing a stream thereof;

providing a supply of first liquid blowing agent at a pressure of less than 500 p.s.i.g., using a second pump to pump said supply of first liquid blowing agent to a pressure of approximately 550 p.s.i.g. to prevent cavitation, further pumping said supply of first volatile liquid blowing agent to a pressure of approximately 5,500 p.s.i.g. and providing a stream thereof;

measuring the flow rate of said stream of carbon dioxide and providing a first signal proportional thereto;

measuring the flow rate of said stream of first blowing agent and providing a second signal proportional thereto;

controlling the flow rate of said stream of first blowing agent responsive to said first and second signals whereby to provide a ration of blowing agent and carbon dioxide;

mixing said streams of carbon dioxide and first blowing agent at a pressure of approximately 5,500 p.s.i.g. to form a blend thereof; and pumping said blend into said extruder whereby to form a foamed thermoplastic mass.

2. The method of claim 1, wherein the pressure under which said carbon dioxide is maintained in a liquid state is within a range of 250–300 p.s.i.g.

3. The method of claim 1, wherein said refrigerated supply of carbon dioxide is maintained at −8 degrees Fahrenheit.

4. The method of claim 1, wherein said stream of first blowing agent is a hydrocarbon.

5. The method of claim 4, wherein said hydrocarbon is n-pentane.

6. The method of claim 4, wherein said hydrocarbon is a halogenated hydrocarbon.

7. The method of claim 1, further comprising:

providing a supply of a second liquid blowing agent, pumping said supply of second liquid blowing agent to a pressure of approximately 550 p.s.i.g to prevent cavitation, further pumping said supply of second liquid blowing agent to a pressure of approximately 5,500 p.s.i.g. and providing a stream thereof to said blend of carbon dioxide and first liquid blowing agent; and measuring the flow rate of said stream of second liquid blowing agent and providing a third signal proportional thereto, controlling the flow rate of said steam of said second liquid blowing agent in response to said third signal whereby to provide a ratio of said second liquid blowing agent with said blend.

8. The method of claim 7, further comprising the step of mixing said second blowing agent with said blend.

9. The method of claim 7, wherein said stream of second liquid blowing agent is a hydrocarbon.

10. The method of claim 7, wherein said stream of second liquid blowing agent is HCFC-22.

11. The method of claim 1, in which said step of controlling the flow of said stream of blowing agent comprises:

comparing the flow rates of said stream of carbon dioxide and said stream of blowing agent and regulating the flow rate of said stream of blowing agent in accordance with said ratio.

* * * * *

UNITED STATES PATENT AND TRADEMARK OFFICE

CERTIFICATE OF CORRECTION

PATENT NO. : 5,823,669
DATED : October 20, 1998
INVENTOR(S) : Clifford Jones

It is certified that error appears in the above-identified patent and that said Letters Patent is hereby corrected as shown below:

Title page, item [73], Assignee: delete "Lolco" and insert -- Dolco --.

Signed and Sealed this

Twelfth Day of January, 1999

*Attest:*

*Attesting Officer*

*Acting Commissioner of Patents and Trademarks*